United States Patent [19]

Richardson et al.

[11] Patent Number: 4,680,941

[45] Date of Patent: Jul. 21, 1987

[54] WASTE HEATING RECOVERY SYSTEM

[76] Inventors: Elvet M. Richardson, 18 Marshall St., Irvington, N.J. 07111; Teik P. Sim, 144-45 Charter Rd., Jamica, N.Y. 11435

[21] Appl. No.: 865,404

[22] Filed: May 21, 1986

[51] Int. Cl.[4] ..... F25B 39/04

[52] U.S. Cl. ..... 62/184; 62/238.6

[58] Field of Search ..... 62/238.6, 238.7, 180, 62/181, 183, 184; 237/2 B

[56] References Cited

U.S. PATENT DOCUMENTS

| | | | |
|---|---|---|---|
| 1,786,861 | 12/1930 | Miller | 62/79 |
| 1,937,288 | 11/1933 | McGraw | 62/115 |
| 2,102,940 | 8/1938 | Buchanan | 62/115 |
| 2,125,842 | 12/1937 | Eggleston | 237/12.4 |
| 2,162,245 | 6/1939 | Comstock | 62/115 |
| 2,551,758 | 5/1951 | Newton | 236/92 |
| 2,575,325 | 11/1951 | Ambrose et al. | 62/6 |
| 2,632,306 | 3/1953 | Ruff | 62/4 |
| 3,922,876 | 12/1975 | Wetherington | 62/180 |
| 4,141,222 | 2/1979 | Ritchie | 62/179 |
| 4,142,379 | 3/1979 | Kuklinski | 62/179 |
| 4,179,902 | 12/1979 | Mueller et al. | 62/238.6 |
| 4,199,955 | 4/1980 | Jonsson | 62/79 |
| 4,226,606 | 9/1980 | Yaeger et al. | 62/238 |
| 4,241,588 | 12/1980 | Murphy et al. | 62/238.6 |
| 4,246,764 | 1/1981 | Papadakos | 62/183 |
| 4,423,602 | 1/1984 | Venable | 62/238.6 |

*Primary Examiner*—Harry Tanner

*Attorney, Agent, or Firm*—Cushman, Darby & Cushman

[57] ABSTRACT

An apparatus for recovering waste heat from conventional refrigerating systems in which a heat exchanger is connected between the compressor and condenser to transfer heat to water pumped therethrough. The heated water is stored in a small holding tank and transferred to a larger water storage tank when hot water is withdrawn from the larger tank.

2 Claims, 2 Drawing Figures

WASTE HEATING RECOVERY SYSTEM

BACKGROUND AND SUMMARY OF THE INVENTION

The invention relates to an apparatus and system for recovering waste heat from refrigeration systems.

Conventional refrigeration systems circulate a refrigerating fluid which is evaporated within the refrigerating compartment to absorb heat which is transferred outside the compartment when the gas is condensed back to its liquid state. In most homes and businesses having such refrigeration systems there is also a need for hot water. Many proposals have been made in the past to use the waste heat from the refrigeration system to in whole or part heat water for domestic or industrial use. For example, the patent to McGraw, U.S. Pat. No. 1,937,288, shows a system of this type in which hot refrigeration liquid passes through a heat exchanger to heat water in a tank. The patent to Johnson, U.S. Pat. No. 4,199,955, describes another system of this type. A great variety of such waste recovery systems have in the past been proposed.

The present invention relates to an improved and practical system which is economical, can be installed with minimum difficulty, is reliable, and is designed to supplement an existing hot water system. According to the present invention a heat exchanger is inserted into a conventional refrigerating system between the compressor and the condenser. A water line passes through the heat exchanger between an inlet which receives cold water and an outlet which supplies the heated water to a small holding tank which can be located immediately adjacent to the refrigeration system. The holding tank is coupled to a larger storage tank, for example, a conventional home water heater, by a check valve so that the heated water from the holding tank is transferred to the larger storage tank whenever water is withdrawn from the larger tank.

A pump is connected between the outlet of the holding tank and the inlet of the heat exchanger for circulating the water through the heat exchanger. A temperature sensor is preferably provided to detect the temperature of the gases from the compressor so that the pump is operated only when there is heat to be transferred to the water. A heat sensor is also preferably provided at the holding tank to turn off the pump when the water has reached its maximum temperature.

The system can be used with a single refrigerator, air conditioner of the like or can be used in an apartment building or industrial establishment with the hot water from the various holding tanks being supplied to a single central hot water heater or storage tank.

Other objects and purposes of the invention will be clear from the following brief description of the drawings.

DETAILED DESCRIPTION OF THE DRAWINGS

Figure 1:
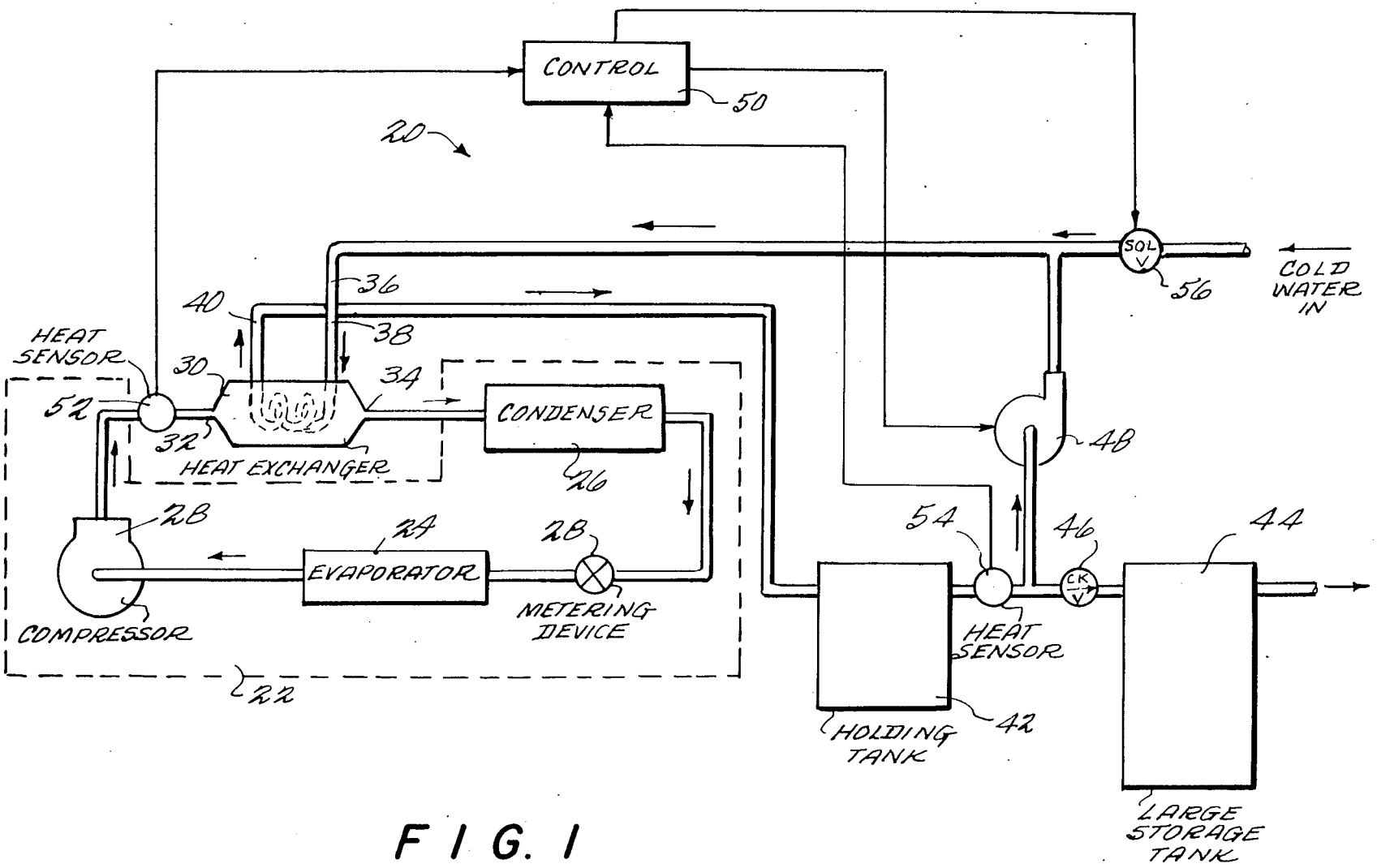
FIG. 1 shows a schematic view of one embodiment of the present invention.

Reference is now made to FIG. 1 which illustrates a first embodiment of the present invention. In this embodiment the apparatus 20 of the present invention is connected and coupled to a conventional refrigeration system indicated as 22 and surrounded by dashed lines. In this conventional system the refrigerating fluid as gas from evaporator 24 is pumped to condenser 26 by compressor 28. A conventional metering device is also supplied in the circulating loop.

Modification of this system to recover the waste heat requires only insertion of a heat exchanger 30 between the compressor 28 and the condenser 26. This is a simple plumbing task which can be carried out by any competent plumber.

Heat exchanger 30 includes an internal space through which the refrigerating fluid flows between an inlet 32 and an outlet 34. A water line 36, for example, of copper, is formed with a coil inside the internal space. Water circulates from an inlet 38 to an outlet 40 of the water line with heat in the refrigerating fluid being transferred to the water line. Cold water is supplied to the inlet of the line 36 from a suitable source of cold water of the building or business. Outlet 40 is connected to a holding tank 42 which may be, for example, of 5 to 10 gallons capacity. Since the size of this tank is modest, it can be easily mounted closely adjacent to the refrigeration system, thereby minimizing wasted energy in circulating water and minimizing the cost of piping.

Holding tank 42 is in turn connected to a conventional storage tank 44 preferably and usually the hot water tank serving the home or business. Check valve 46 is provided between holding tank 42 and storage tank 44 to insure that there is no flow of hot water in the opposite direction. When hot water is conventionally withdrawn from storage tank 4 the pressure in holding tank 42 becomes greater than that in storage tank 44 so that the preheated water is drawn into the storage tank.

A conventional pump 48 is connected between the outlet of holding tank 42 and the inlet of water line 36. Pump 48 thereby continually circulates the water under control of a conventional control circuit 50.

Control circuit 50 is connected to a conventional heat sensor 52 which senses the temperature of the refrigerating gases. If there is no heat to transfer to the water economically then control 50 turns off pump 48 thereby avoiding unnecessary use of energy. The similar heat sensor 54 is connected at the outlet of holding tank 42. If the circulating water has reached its maximum temperature, similarly pump 48 is turned off to avoid waste of energy. Solenoid valve 56 is operated by the control circuit 50 to supply cold water to the system when the pump is not operating and when water is required.

To some extent the system of the present invention operates as a preheater for the hot water tank. For most refrigeration systems it is possible using the present invention to raise the temperature of the water in the holding tank to about 110° F. Conventional storage tank 44 then raises the temperature further to whatever level is desired.

One particular advantage of the present invention is that it can be readily installed either as a single individual unit or combined in a facility where a number of refrigeration systems are in operation, for example, in an apartment building. It can also be readily installed in either new or existing systems.

Figure 2:
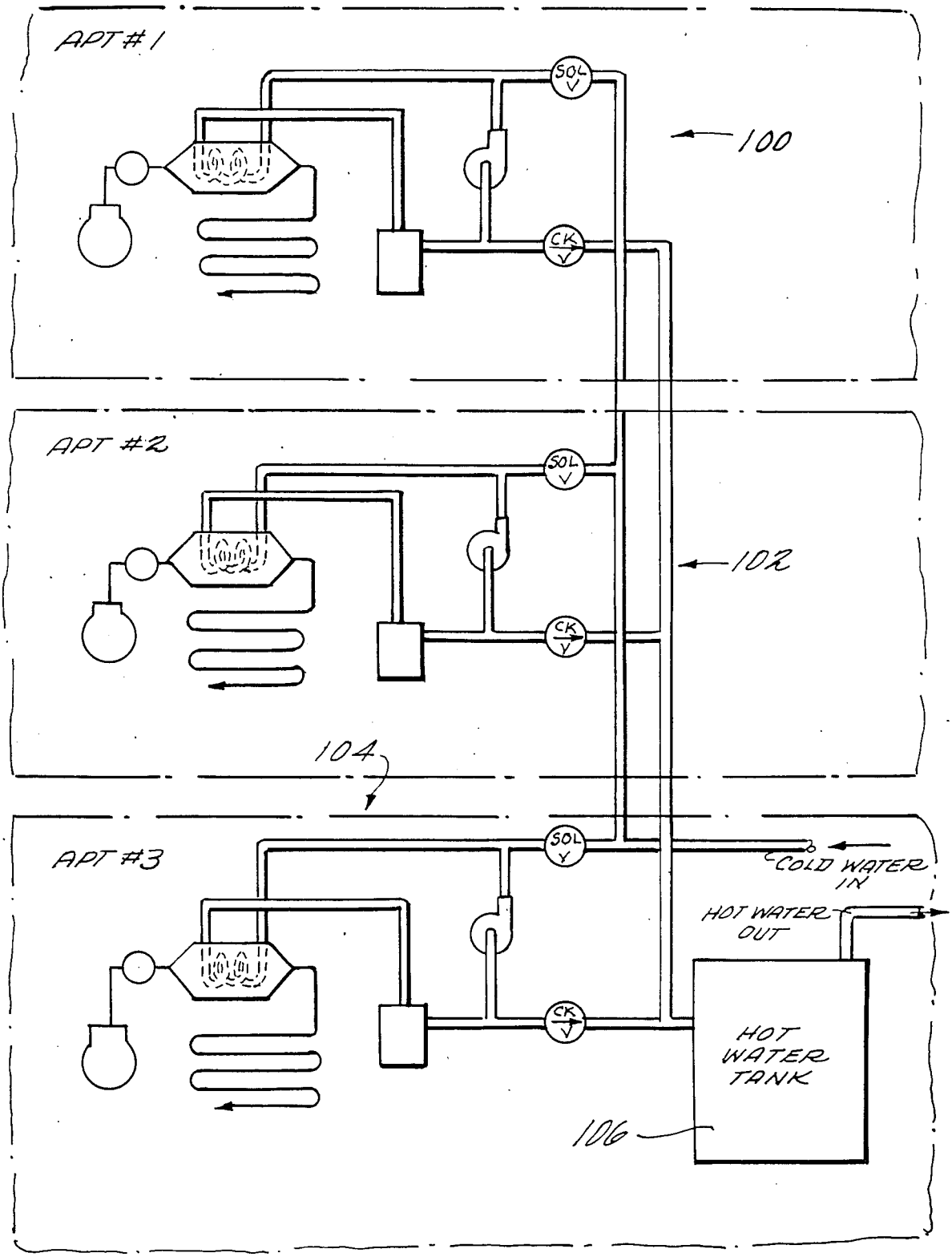
FIG. 2 shows a schematic view of the embodiment of FIG. 1 in use in a multiple refrigeration system facility supplying hot water to a single hot water storage tank.

FIG. 2 shows the use of the system of the present invention with three units, 100, 102, and 104 as described above, supplying heated water to a conventional hot water tank 106 which supplies the building.

Many changes and modifications in the above described embodiment of the present invention can of course be made without departing from the scope of the invention. Accordingly that scope is intended to be limited only to the scope of the appended claims.

What is claimed is:

1. An apparatus for recovering waste heat from a refrigeration system having a compressor, condensor and evaporator coupled together for circulating a refrigerant comprising:

heat exchanger means adapted to be connected to said system between said compressor and condensor and having an inlet for receiving said refrigerant from said compressor and an outlet for supplying said refrigerant to said condensor and a water line passing therethrough to which heat is transferred from said refrigerant, said water line being adapted to be connected at one end to a source of cold water;

a holding tank connected to the other end of said water line for receiving at an inlet water to which heat has been transferred and storing said water and having an outlet;

means connected to said holding tank outlet and adapted to be connected to a water storage tank having a capacity greater than the capacity of said holding tank by means of one way valve means so that heated water flows from said holding tank to said storage tank when the pressure in said storage tank drops below the pressure in said holding tank upon removal of water from said storage tank; and pump means connected between said holding tank outlet and connected to said heat exchanger means inlet by said water line for circulating heated water from said holding tank;

means for sensing the temperature of said refrigerant prior to passage through said heat exchanger;

means for sensing the temperature of said heated water prior to passage through said pump means;

solenoid valve means connected between said water line and said source of cold water; and a central control unit means for causing said pump means to circulate water when either the temperature sensed by said refrigerant temperature sensing means is above a predetermined value, or the temperature sensed by said water temperature sensing means is below a predetermined value, and for opening said solenoid valve means when said pump means is not operating to circulate water.

2. An apparatus as in claim 1 wherein said water line passes through said heat exchanger means so as to be entirely surrounded therein by said circulating fluid.

* * * * *